US008505261B2

(12) United States Patent
McClure

(10) Patent No.: US 8,505,261 B2
(45) Date of Patent: Aug. 13, 2013

(54) SLIDING ROOF SEAM CONSTRUCTION

(75) Inventor: Richard R. McClure, Basehor, KS (US)

(73) Assignee: BlueScope Buildings North America, Kansas City, MO (US)

( * ) Notice: Subject to any disclaimer, the term of this patent is extended or adjusted under 35 U.S.C. 154(b) by 1235 days.

(21) Appl. No.: 11/845,820

(22) Filed: Aug. 28, 2007

(65) Prior Publication Data

US 2009/0056240 A1 Mar. 5, 2009

(51) Int. Cl.
*E04B 1/38* (2006.01)

(52) U.S. Cl.
USPC ..... 52/713; 52/545; 52/588.1

(58) Field of Classification Search
USPC ..... 52/713, 520, 547, 528, 529, 530, 52/531, 537, 538, 545, 546, 588.1
See application file for complete search history.

(56) References Cited

U.S. PATENT DOCUMENTS

| | | | | |
|---|---|---|---|---|
| 2,116,532 | A | 5/1938 | McCabe | |
| 2,151,221 | A | 3/1939 | Meeker | |
| 3,296,751 | A * | 1/1967 | Heirich | 52/38 |
| 3,858,373 | A * | 1/1975 | Day et al. | 52/713 |
| 3,998,019 | A | 12/1976 | Reinwall, Jr. | |
| 4,034,532 | A | 7/1977 | Reinwall, Jr. | |
| 4,177,615 | A * | 12/1979 | Anderson | 52/478 |
| 4,184,299 | A | 1/1980 | East | |
| 4,193,247 | A | 3/1980 | Heckelsberg | |
| 4,213,282 | A * | 7/1980 | Heckelsberg | 52/404.2 |
| 4,307,553 | A * | 12/1981 | Puckett | 52/470 |
| 4,361,998 | A | 12/1982 | Ellison et al. | |
| 4,366,656 | A * | 1/1983 | Simpson | 52/395 |
| 4,466,224 | A * | 8/1984 | Hague | 52/478 |
| 4,467,582 | A * | 8/1984 | Hague | 52/478 |
| 4,495,743 | A * | 1/1985 | Ellison et al. | 52/478 |
| 4,514,952 | A | 5/1985 | Johansson | |
| 4,575,983 | A | 3/1986 | Lott, Jr. et al. | |
| 4,796,403 | A | 1/1989 | Fulton et al. | |
| 4,833,853 | A * | 5/1989 | Deibele et al. | 52/410 |
| 5,001,882 | A | 3/1991 | Watkins et al. | |
| RE33,566 | E * | 4/1991 | Heckelsberg | 52/520 |
| 5,127,205 | A * | 7/1992 | Eidson | 52/520 |
| 5,181,360 | A * | 1/1993 | Shingler | 52/520 |
| 5,222,341 | A | 6/1993 | Watkins et al. | |
| 5,511,354 | A | 4/1996 | Eidson | |
| 5,600,971 | A | 2/1997 | Suk | |

(Continued)

FOREIGN PATENT DOCUMENTS

| | | |
|---|---|---|
| DE | 6932799 U | 11/1969 |
| GB | 2198161 A | 6/1988 |

OTHER PUBLICATIONS

International Search Report and Written Opinion in related PCT Application Serial No. PCT/US08/71477, filed Jul. 29, 2008, issued Oct. 23, 2008, 17 pages.

*Primary Examiner* — William Gilbert
*Assistant Examiner* — James Ference
(74) *Attorney, Agent, or Firm* — Lathrop & Gage LLP

(57) ABSTRACT

A sliding bracket assembly permits adjacent metal roof panels to move relative to one another to accommodate differential thermal expansion. The assembly includes a center element which is bolted across a purlin, and a pair of wing elements, one on either side of the center element. Roof panels are attached to the wing elements on either side. The wing elements can side lengthwise on the center element; thus the wing elements and their attached roof panels can move lengthwise relative to one another as the roof panels differentially expand and contract.

22 Claims, 4 Drawing Sheets

(56) References Cited

U.S. PATENT DOCUMENTS

| | | | | |
|---|---|---|---|---|
| 5,606,838 | A | 3/1997 | Hughes et al. | |
| 5,715,640 | A * | 2/1998 | Haddock | 52/545 |
| 5,911,663 | A | 6/1999 | Eidson | |
| 6,715,256 | B1 | 4/2004 | Fischer | |
| 6,845,592 | B2 | 1/2005 | Voegele | |
| 6,889,478 | B1 * | 5/2005 | Simpson | 52/520 |
| 7,013,612 | B2 * | 3/2006 | Haddock | 52/545 |
| 7,100,338 | B2 * | 9/2006 | Haddock | 52/545 |
| 2002/0088196 | A1 * | 7/2002 | Haddock | 52/543 |
| 2005/0011154 | A1 | 1/2005 | Kim | |
| 2005/0102943 | A1 | 5/2005 | Voegele | |
| 2006/0174571 | A1 * | 8/2006 | Panasik et al. | 52/478 |

* cited by examiner

SLIDING ROOF SEAM CONSTRUCTION

BACKGROUND OF THE INVENTION

This invention relates to a sliding roof seam construction to accommodate differential expansion of adjacent metal panels.

A typical metal roof construction includes an array of metal purlins laid across structural beams. The purlins and beams are referred to below as the "substructure" of the roof. Most purlins have a "C" or "Z" cross-section with upper and lower flanges at either edge of a central web. "Z"-shaped members are popular because they have the advantage of being nestable. The roof substructure supports an array of interlocked metal roof panels, often with a layer of insulation beneath the panels. The roof panels are laid perpendicularly across the purlins so that, on a ridge roof, the panels extend from the ridge to the eave. Normally, the panels are fixed to the eave, and are supported in a way that lets them expand and contract lengthwise, yet prevents them from being lifted off the purlins by high winds. Widthwise expansion is not normally a problem, because the panels are typically corrugated; however, lengthwise expansion cycles can be considerable, inasmuch as ambient temperatures vary annually by as much as 100° F. The upper extreme is augmented by solar heating, which causes the to roof expand and contract considerably, even at constant ambient temperature, as the sun rises, sets and is hidden by clouds. For these reasons, roof panels must be connected to the substructure in a way that permits the panels to move considerably in the lengthwise direction. Usually the panels are fixed to the substructure at the eaves, and are permitted to expand toward the roof ridge, where their ends are covered loosely by a cap.

In a standard warehouse-style building with a rectangular footprint, the panels are all the same length, and as the panels are laid, their overlapped edges are tightly folded over to form a weather-proof structure. Various specialized roof seaming machines exist for this purpose. Panels of equal length expand and contract in unison as thermal variations occur.

When a roof has an inside corner, however, panels of one length are laid adjacent panels of a substantially different length, extending from eaves at different distances from the ridge. Such a roof is illustrated in FIG. 4. When the panels are heated or cooled, differential thermal expansion causes relative lengthwise movement in the panels on either side of the "shear line" SL. The edges of these panels cannot be seamed together without creating a danger of buckling or other structural damage resulting from differential thermal expansion.

SUMMARY OF THE INVENTION

An object of the present invention is to allow a construction in which adjacent roof panels of different lengths, or having offset anchoring eaves or different coefficients of thermal expansion, can be securely held on the roof without seaming the overlapping edges those panels.

This object is achieved by a sliding roof seam construction as described below.

BRIEF DESCRIPTION OF THE DRAWINGS

In the accompanying drawings.

DESCRIPTION OF THE PREFERRED EMBODIMENT

Figure 1:
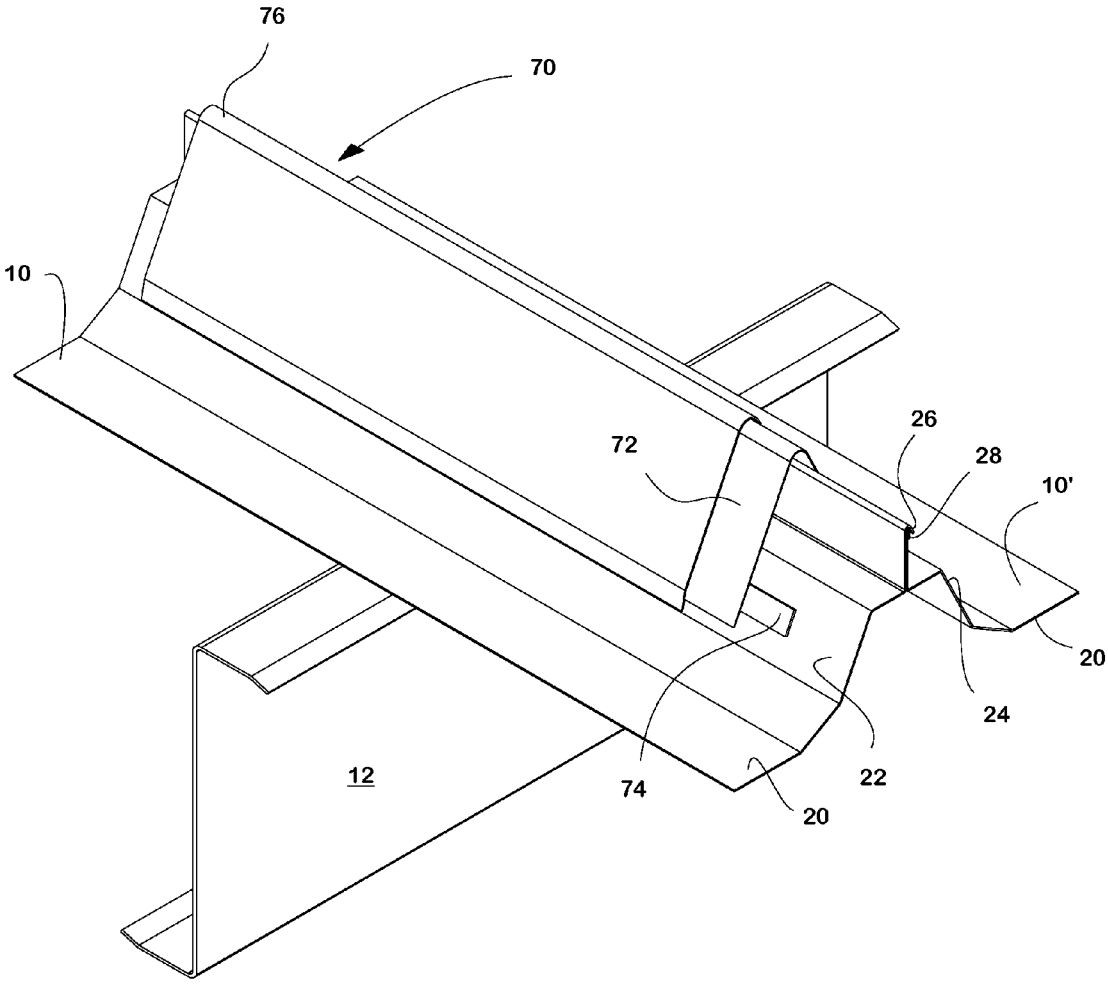
FIG. 1 is a perspective view from above of a roof seam embodying the invention.

A portion of a roof seam embodying the invention is illustrated in FIG. 1. The roof panels 10 are supported by parallel purlins (or "roof substructure") 12, only one of which is shown. On a sloping roof, the purlins normally run parallel to the ridge of the roof. The purlins, in turn, are supported by structural members running from the cave to the ridge.

Figure 4:
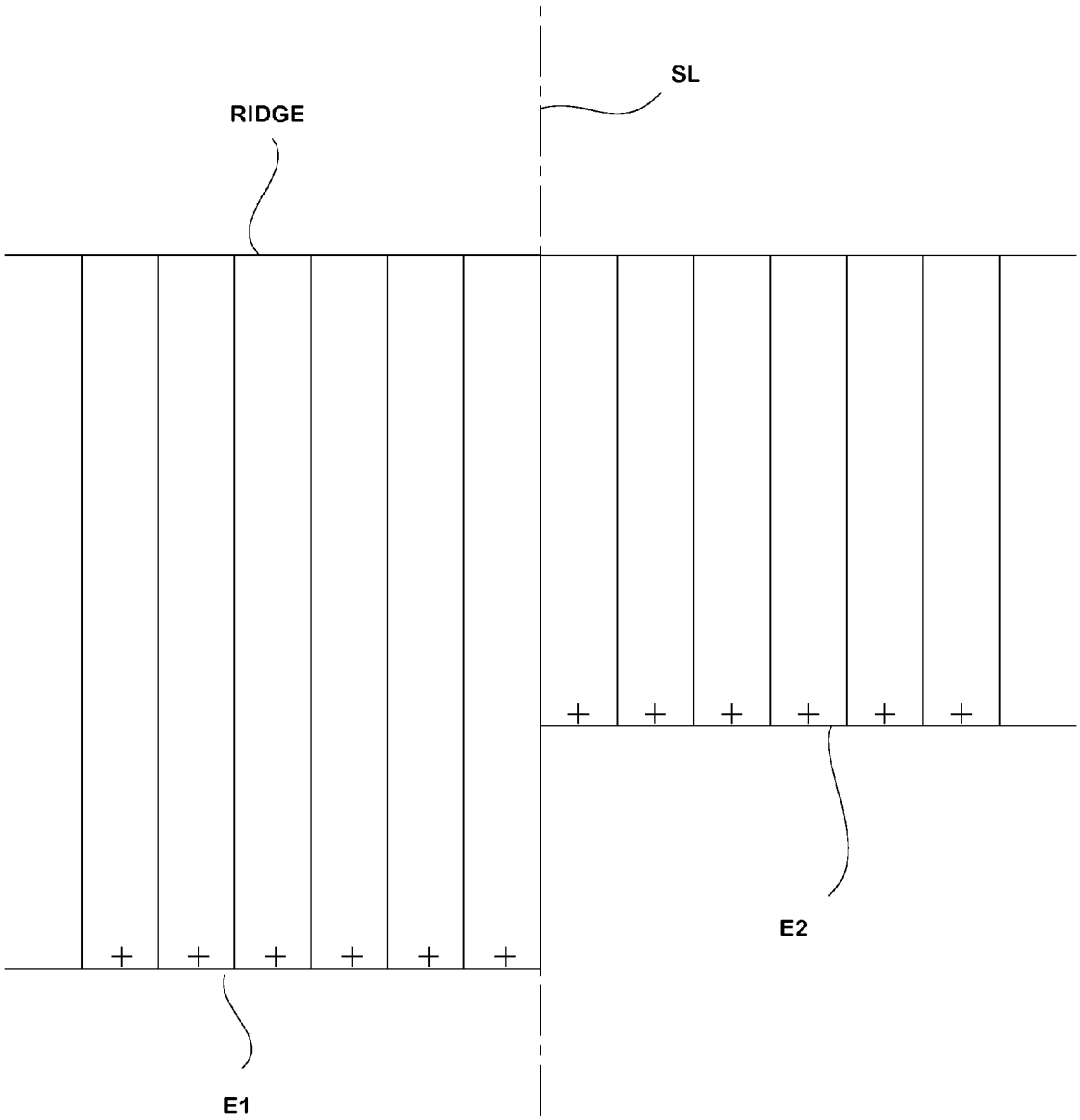
FIG. 4 shows a roof having an inside corner.

In the drawings, portions of two roof panels 10 and 10' of different lengths are shown secured to respective eaves E1, E2 (FIG. 4) which are substantially offset from one another. Details of the eave construction are not important to this explanation. What is important is the way in which the panels 10 and 10' are interconnected and supported on the purlins.

As FIG. 1 shows, each panel has a broad central portion 20 bounded by raised side portions 22, 24 respectively having complementary edge structures 26, 28 respectively which are designed to be folded over to form a seam. Most of the panel joints on the roof are folded into seams, but between adjacent panels of different length (along the "shear" line) SL, the panel edges are left unfolded. To secure the panels to the purlins, and yet to allow the panels to move lengthwise with respect to one another on the shear line, expansion bracket assemblies are installed along the shear line.

Figure 2:
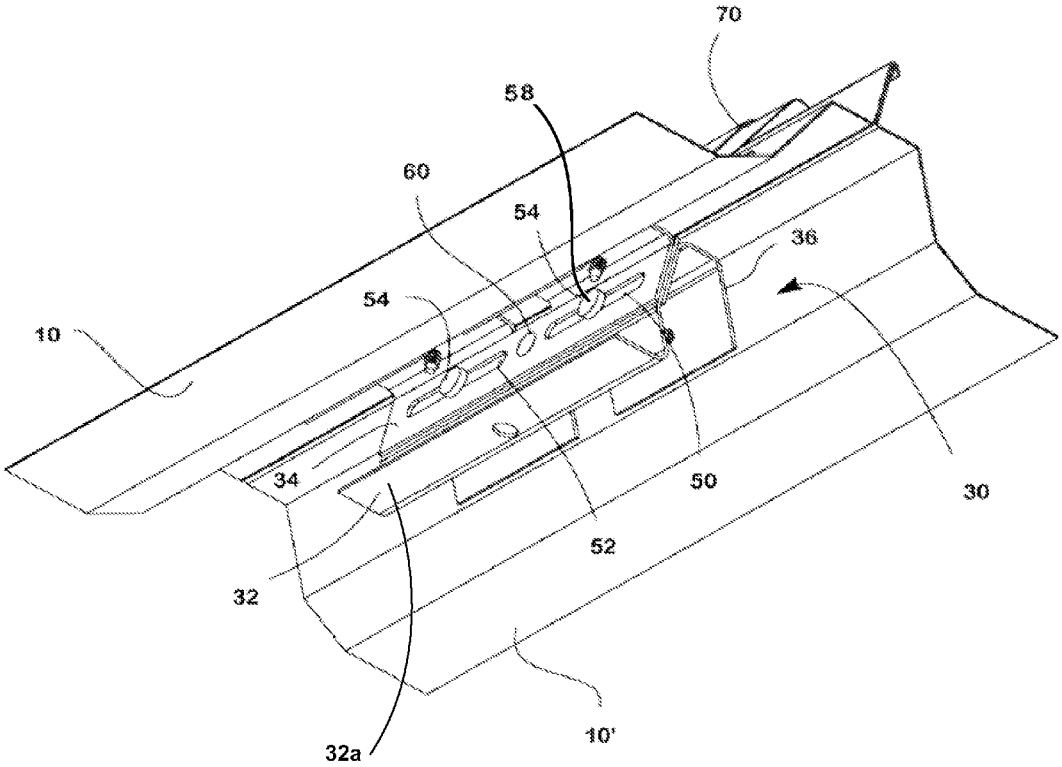
FIG. 2 is a perspective view thereof from below.
Figure 3:
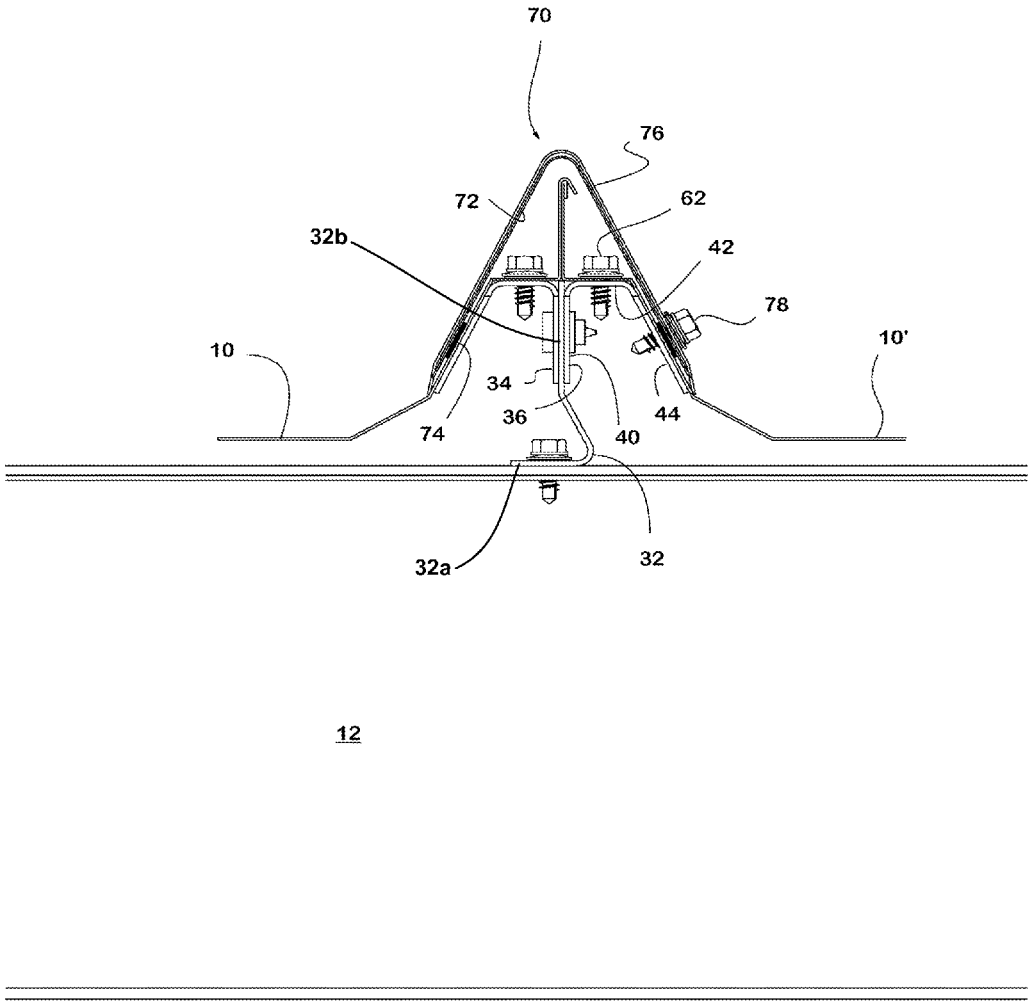
FIG. 3 is an end view thereof.

The expansion bracket assembly 30, best seen in FIG. 2, includes a center (or "base") element 32 which is laid perpendicularly across and bolted to a purlin 12 (at attachment portion 32*a*), a first wing element 34 on one side of the center element 32 (i.e., at one side of distal portion 32*b*), and a second wing element 36 on the opposite side of the center element 32 (i.e., at the opposite side of the distal portion 32*b*). The first and second wing elements are substantially mirror images of one another. Each has a vertical segment 40 (FIG. 3) which overlaps the center element 32, a horizontal segment 42 extending outward from the vertical web, and an oblique segment 44 bent at an angle so as to conform to the shape of the corrugation on the roof panel.

Two slots 50, 52 (FIG. 2) are formed in the vertical segment 40 of the center element 32. The slots extend in a direction parallel to the panel edges and are sized so that the shaft of a rivet 54, but not the head 58 thereof, can pass through either slot. The rivet also extends through a hole in the center element. The rivets are sized to hold the wing elements against the center element, but not tightly, inasmuch as the elements must be able to slide relative to one another in use.

To stabilize the bracket assembly for ease of handling, a nylon centering pin 60 is inserted at the factory through aligned holes which are formed, respectively, as the center of each of the elements.

During installation, an expansion bracket assembly is placed across each of the purlins with the bottom flange of the center element overlapping the top flange of the purlin. A fastener such as a self-drilling and self-tapping screw is driven through the overlapped flanges to secure the assembly to the purlin. The nylon centering pin, which prevents the wing brackets from shifting about during installation need not be removed by the installer. It shears off after installation, when thermal effects shift the roof panels with respect to one another.

Once the expansion bracket assemblies 30 have been installed along the shear line, the roof panels are placed on the roof, with their complementary edges 26, 28 overlapped in the usual way to form a seam. All roof joints except those along the shear line are folded together to form seams. Those on the shear line are left undeformed so that relative sliding movement can occur.

To connect the roof panels to the bracket, suitable fasteners 62 are driven through the raised side portions of the roof panels and the oblique webs of the wing brackets, where they overlap. The fasteners may be self-drilling, self-tapping screws. The screws are tightened sufficiently to prevent any movement between the panels and the underlying brackets.

If left unsealed, the joint along the shear line might provide a site for entry of cold air, rain water, dust or insects. To prevent leakage and to keep foreign material out of the joint, a cover 70 is installed over the undeformed joint. The cover includes a flexible seal 72, for example a silicone membrane, which is secured to the respective side portions of the roof panels by a continuous adhesive sealant strip 74 (FIG. 3) applied during installation. The membrane is flexible enough to accommodate the substantial anticipated lengthwise shifting of the panels on either side of the shear line. Preferably, the cover also includes a metal canopy 76 lying over the membrane and having the shape of an inverted "V" whose bend angle conforms to the roof panel corrugations beneath. The metal canopy, which is secured by screws 78 which are inserted through one side of the canopy and the underlying wing bracket, not only protects the membrane from damage but also presents a good finished appearance. However, the metal canopy is considered an optional feature and may in some instances not be necessary.

Details of the elements of the invention may vary. For example, the choice of materials, metal gauges, and the exact location and nature of the fasteners and pins which interconnect the various parts are a matter of design choice. Also, the invention might be used to compensate for differential expansion in a construction where panels made of different materials were laid side-by-side. Since the invention is subject to modifications and variations, it is intended that the foregoing description and the accompanying drawings shall be interpreted as only illustrative of the invention defined by the following claims.

I claim:

1. A differential expansion roof bracket for securing metal roof panels to a roof substructure while permitting differential thermal expansion of laterally adjacent roof panels, said bracket comprising:

a center element having a lengthwise direction;

a pair of wing elements, one on either side of the center element;

at least one retainer for securing both wing elements to the center element in a way that allows the wing elements to move in the lengthwise direction relative to one another and relative to the center element as the roof panels expand and contract; and fasteners for securing the roof panels to the respective wing elements.

2. The bracket of claim 1, wherein the fasteners are self-drilling self-tapping bolts.

3. A differential expansion roof bracket for securing metal roof panels to a roof substructure while permitting differential thermal expansion of first and second laterally adjacent roof panels, the bracket comprising:

a center element having a lengthwise direction;

first and second wing elements; the first wing element extending to one side of the center element, the second wing element extending to the other side of the center element;

at least one retainer for securing both wing elements to the center element in a way that allows the wing elements to respectively move in the lengthwise direction relative to one another and relative to the center element as the roof panels expand and contract;

means for fixedly attaching the first roof panel to the first wing element such that movement of the first roof panel causes movement of the first wing element in the lengthwise direction relative to the second wing element, the second roof panel, and the center element; and means for fixedly attaching the second roof panel to the second wing element such that movement of the second roof panel causes movement of the second wing element in the lengthwise direction relative to the first wing element, the first roof panel, and the center element.

4. The bracket of claim 3, further comprising:

a cover configured for installation over an edge of the first roof panel and an edge of the second roof panel to prevent air, water and contaminants from passing between the edges of the panels; the cover having a first seal for sealing the cover to the first roof panel and a second seal for sealing the cover to the second roof panel; and means for fixedly coupling the cover to the first wing element or the second wing element but not both wing elements.

5. The bracket of claim 4, wherein the first seal comprises a flexible membrane and the second seal comprises a flexible membrane.

6. The bracket of claim 5, wherein the cover comprises a metal canopy overlying the flexible membranes.

7. The bracket of claim 1, wherein:

each of the wing elements has at least one slot extending in the lengthwise direction;

the center element has at least one hole alignable with the slots; and the retainer passes through the slots and the hole and has end portions larger than the slots which retain the wing elements against the center element while permitting the wing elements to slide in the lengthwise direction with respect to one another.

8. The bracket of claim 7, wherein the retainer is a rivet.

9. The bracket of claim 1, wherein the center element is sandwiched between the first and second wing elements.

10. A roof, comprising:

a substructure;

first and second metal roof panels atop the substructure, wherein the first and second panels are on opposite sides of a shear line and have different lengths or different coefficients of thermal expansion; and a plurality of differential expansion brackets supporting the metal roof panels along the shear line, each differential expansion bracket comprising:

a center element having a lengthwise direction;

first and second wing elements; the first wing element extending to one side of the center element, the second wing element extending to the other side of the center element;

at least one retainer for securing both wing elements to the center element in a way that allows the wing elements to respectively move in the lengthwise direction relative to one another and relative to the center element as the roof panels expand and contract;

wherein the first roof panel is fixed to the first wing element such that movement of the first roof panel causes movement of the first wing element in the lengthwise direction relative to the second wing element, the second roof panel, and the center element; and wherein the second roof panel is fixed to the second wing element such that movement of the second roof panel causes movement of the second wing element in the lengthwise direction relative to the first wing element, the first roof panel, and the center element.

11. The roof of claim 10, further comprising:

a cover configured for installation over an edge of the first roof panel and an edge of the second roof panel to prevent air, water and contaminants from passing between the edges of the panels; the cover having a first seal for sealing the cover to the first roof panel and a second seal for sealing the cover to the second roof panel; and means for fixedly coupling the cover to the first wing element or the second wing element of a respective bracket but not both wing elements.

12. The roof of claim 11, wherein the first seal comprises a flexible membrane and the second seal comprises a flexible membrane.

13. The roof of claim 12, wherein the cover comprises a metal canopy overlying the flexible membranes.

14. The roof of claim 10, wherein for each bracket:

each of the wing elements has at least one slot extending in the lengthwise direction;

the center element has at least one hole alignable with the slots; and the retainer passes through the slots and the hole and has end portions larger than the slots which retain the wing elements against the center element while permitting the wing elements to slide in the lengthwise direction with respect to one another.

15. The roof of claim 10, further comprising means in each bracket for temporarily coupling the first and second wing elements to the center element to restrain movement of the first and second wing elements relative to the center element during installation of the center element to the substructure, installation of the first roof panel to the first wing element, and installation of the second roof panel to the second wing element; after the center element, the first roof panel, and the second roof panel are installed, the means for temporarily coupling being overcome such that the first and second wing elements are independently movable relative to one another and the center element.

16. The roof of claim 10, wherein each differential expansion bracket further comprises a pin temporarily coupling the first and second wing elements to the center element to restrain movement of the first and second wing elements relative to the center element until the first and second roof panels are fixed to the first and second wing elements and move relative to the center element; the pin shearing off after the first and second roof panels are fixed to the first and second wing elements due to movement of at least one of the first wing element and the second wing element relative to the center element.

17. A roof bracket for securing first and second adjacent roof panels to a roof substructure while allowing the first and second roof panels to move independently relative to one another, the bracket comprising:

a base element having an attachment portion configured to be fixed to the roof substructure and a distal portion extending generally perpendicular to the attachment portion;

a first wing element extending to one side of the base element distal portion;

a second wing element extending to the other side of the base element distal portion; and a retainer securing the first wing element to the base element distal portion such that the first wing element is movable along the base element distal portion independent of the second wing element;

wherein either the retainer or another retainer secures the second wing element to the base element distal portion such that the second wing element is movable along the base element distal portion independent of the first wing element.

18. The bracket of claim 17, further comprising:

means for fixedly attaching the first roof panel to the first wing element such that movement of the first roof panel causes movement of the first wing element in the lengthwise direction relative to the second wing element, the second roof panel, and the base element; and means for fixedly attaching the second roof panel to the second wing element such that movement of the second roof panel causes movement of the second wing element in the lengthwise direction relative to the first wing element, the first roof panel, and the base element.

19. The bracket of claim 18, wherein:

the first wing element has a generally horizontal portion substantially parallel to the base element attachment portion;

the second wing element has a generally horizontal portion substantially parallel to the base element attachment portion; and the horizontal portion of the first wing element and the horizontal portion of the second wing element are each spaced apart from the base element attachment portion at least as far as an upper end of the base element distal portion is spaced apart from the base element attachment portion such that the base element distal portion does not interfere with attaching the first roof panel to the first wing element and attaching the second roof panel to the second wing element.

20. The bracket of claim 17, wherein:

the first wing element has a generally horizontal portion substantially parallel to the base element attachment portion;

the second wing element has a generally horizontal portion substantially parallel to the base element attachment portion;

the bracket further comprises a fastener for securing the first roof panel to the generally horizontal portion of the first wing element; and the bracket further comprises a fastener for securing the second roof panel to the generally horizontal portion of the second wing element.

21. The bracket of claim 17, further comprising:

a cover configured for installation over an edge of the first roof panel and an edge of the second roof panel;

a first seal for sealing the cover to the first roof panel;

a second seal for sealing the cover to the second roof panel; and means for fixedly coupling the cover to the first wing element or the second wing element but not both wing elements.

22. The bracket of claim 17, further comprising means for temporarily coupling the first and second wing elements to the base element to restrain movement of the first and second wing elements relative to the base element during installation of the base element to the substructure, installation of the first roof panel to the first wing element, and installation of the second roof panel to the second wing element; after the base element, the first roof panel, and the second roof panel are installed, the means for temporarily coupling being overcome such that the first and second wing elements are independently movable relative to one another and the base element.

* * * * *